US007335264B2

(12) United States Patent
Motherwell et al.

(10) Patent No.: US 7,335,264 B2
(45) Date of Patent: Feb. 26, 2008

(54) DIFFERENTIALLY COATED MEDICAL DEVICES, SYSTEM FOR DIFFERENTIALLY COATING MEDICAL DEVICES, AND COATING METHOD

(75) Inventors: John Motherwell, Kinvara (IE); Michael Austin, Tuam (IE); Barry Heaney, Ballybrit (IE)

(73) Assignee: Boston Scientific Scimed, Inc., Maple Grove, MN (US)

( * ) Notice: Subject to any disclaimer, the term of this patent is extended or adjusted under 35 U.S.C. 154(b) by 279 days.

(21) Appl. No.: 10/830,330

(22) Filed: Apr. 22, 2004

(65) Prior Publication Data

US 2005/0238829 A1 Oct. 27, 2005

(51) Int. Cl.
*B05B 13/06* (2006.01)
*B05B 7/06* (2006.01)
*B05C 5/00* (2006.01)

(52) U.S. Cl. ..... 118/317; 118/306; 118/313; 118/316

(58) Field of Classification Search ..... 118/317, 118/306, DIG. 10, 300, 316, 313, 315; 427/2.24, 427/2.1, 2.25, 2.28, 2.3, 2.31; 269/48.2–48.4, 269/37, 45, 50, 52, 58, 17, 48; 606/194
See application file for complete search history.

(56) References Cited

U.S. PATENT DOCUMENTS 2,943,001 A * 6/1960 Socke ..... 427/235
3,353,387 A 11/1967 Johnston
3,410,250 A * 11/1968 Kulie et al. ..... 118/308
3,563,791 A * 2/1971 Janco ..... 427/233
4,043,295 A * 8/1977 Speck et al. ..... 118/317
4,963,306 A * 10/1990 Weldon ..... 264/101
5,345,933 A 9/1994 Peterson et al.
5,445,646 A 8/1995 Euteneuer et al.
5,470,345 A 11/1995 Hassler et al.
5,609,629 A 3/1997 Fearnot et al.
5,645,559 A 7/1997 Hachtman et al.
5,908,656 A 6/1999 Ishikawa et al.
5,997,517 A 12/1999 Whitbourne
5,998,019 A 12/1999 Rosenbaum et al.

(Continued)

FOREIGN PATENT DOCUMENTS

EP 0 099 220 A 7/2003

*Primary Examiner*—Yewebdar Tadesse
(74) *Attorney, Agent, or Firm*—Kenyon & Kenyon LLP

(57) ABSTRACT

A method for coating at least a portion of a medical device having an interior is provided that includes holding the medical appliance from an outside surface, inserting a spray nozzle in a first opening accessing the interior of the medical appliance, and spraying the coating on an inside surface of the medical appliance with the spray nozzle. The method may include inserting a further spray nozzle in a second opening accessing the interior of the medical appliance. The spray nozzle and the further spray nozzle may be opposingly arranged to form a radial nozzle. A device adapted to hold a medical appliance is provided that includes at least two wires and a tensioning arrangement adapted to introduce tension into the two wires. The at least two wires may be adapted to support the medical appliance from an exterior of the medical appliance. An apparatus for coating an interior of a medical appliance is provided. A medical appliance having a differential coating applied by the method is provided. An apparatus for coating an exterior of a medical appliance is provided.

29 Claims, 10 Drawing Sheets

U.S. PATENT DOCUMENTS

| | | | | |
|---|---|---|---|---|
| 6,099,563 | A | 8/2000 | Zhong | |
| 6,162,244 | A | 12/2000 | Braun et al. | |
| 6,162,487 | A | 12/2000 | Darouiche | |
| 6,168,862 | B1 | 1/2001 | Rosenbaum et al. | |
| 6,176,849 | B1 | 1/2001 | Yang et al. | |
| 6,179,817 | B1 | 1/2001 | Zhong | |
| 6,200,626 | B1 | 3/2001 | Grobe, III et al. | |
| 6,231,600 | B1 | 5/2001 | Zhong | |
| 6,251,136 | B1 | 6/2001 | Guruwaiya et al. | |
| 6,261,655 | B1 | 7/2001 | Rosenbaum et al. | |
| 6,299,604 | B1 | 10/2001 | Ragheb et al. | |
| 6,306,176 | B1 | 10/2001 | Whitbourne | |
| 6,375,787 | B1 | 4/2002 | Lukic | |
| 6,503,954 | B1 | 1/2003 | Bhat et al. | |
| 6,610,035 | B2 | 8/2003 | Yang et al. | |
| 6,758,282 | B2 * | 7/2004 | Pliner et al. | 169/43 |
| 2003/0143315 | A1 | 7/2003 | Pui et al. | |
| 2005/0166841 | A1 * | 8/2005 | Robida | 118/500 |

* cited by examiner

DIFFERENTIALLY COATED MEDICAL DEVICES, SYSTEM FOR DIFFERENTIALLY COATING MEDICAL DEVICES, AND COATING METHOD

FIELD OF THE INVENTION

The present invention relates to manufacturing medical appliances. More particularly, the present invention relates to a device and method for differentially coating a stent by using an interior coating nozzle for coating the inside of the stent and an exterior coating nozzle for coating the outside of the stent.

BACKGROUND OF THE INVENTION

Therapeutic coatings may be added to implantable medical devices such as stents. Therapeutic coatings may provide benefits relative to a disease condition, in particular in reducing endothelial restenosis and in reducing thrombus at the stent/body lumen interface.

The bioactive substance may be dissolved or dispersed into a suitable liquid polymer/solvent solution, which may then be deposited onto the device's metal substrate using one of a number of different coating processes.

Some coating processes include air-jet spray, electrostatic discharge deposition, dip coating, fluidized bed, bubble jet printer, and roll coating. An exemplary embodiment of the present invention may provide a deposition process that mitigates the high costs of some drug-eluting substances by applying the coating in a cost-efficient way. A coating process with the ability to deposit two different drug-eluting substances, one on the inside of the stent and one on the outside, may be advantageous.

Drug-eluting stents may be used to address issues of endothelial restenosis and thrombus, which may form at the stent/body lumen interface. These two different responses to the stent may also be further separated into an external and internal orientation relative to the stent. Endothelial restenosis may be a response of the cell tissue to the outside contacting surface of the outside of the stent and may include unwanted cell growth. Thrombus may be a response to the stent cell edges and the internal surface of the stent and may include a clotting of red blood cells.

An anti-restenotic coating may be deposited over the complete surface of the stent, including the inside surface, where it may not be required or may be of less benefit. The main reason for coating the entire surface of the stent may be to ensure, in the absence of a strong intermolecular bond between the coating and stent, that the stent is encapsulated with coating material. An encapsulated coating may help retain the coating on the stent. Polymer-based coatings may not adhere to stents constructed of stainless steel, nitinol, and/or other materials, and the most effective manner of coating a stent may be to completely encapsulate the stent. In this manner, the polymer coating bonds to itself to maintain the integrity of the coating.

Conventional mounts for individual stents may include a crosswire, which may in turn be mounted on a supporting wire preform which may be referred to as a C frame. A vertical rotary spindle may carry in the upward facing end a mating drive socket into which the lower end of the C frame is received and engaged. When the nozzle is spraying coating fluid, the C frame and stent drive arrangement may be rotated and raised to bring the stent into the path of the spray plume. The rotary drive and mount may also be designed to pass in a linear manner through the plume from one side to the other. This may ensure a full and/or equal coverage of the stent, and may also ensure that the inside surface of the stent is also coated.

There thus is a need for a method of providing a differential coating on a medical appliance, and in particular a method for depositing a different coat on the inside of a stent than the coat deposited on the outside of the stent.

SUMMARY

According to an exemplary embodiment of the present invention, a method for differentially coating medical appliances is provided. The exemplary method may be appropriate for coating hollow cylindrical devices with one coating on the interior and another on the exterior. A medical appliance produced by the method may be provided, a device for holding a medical appliance may be provided, and an apparatus for coating an interior of the medical appliance may be provided.

A new coating process for medical devices may address several requirements. The process may utilize a radial gap spray nozzle that deposits coating on the inside of the stent. The process may provide for the linear movement of the nozzle relative to the stent in order to coat the complete internal surface. A new method of holding the stent may be provided.

A method for coating at least a portion of a medical device having an interior is provided that includes holding the medical appliance from an outside surface, inserting a spray nozzle in a first opening accessing the interior of the medical appliance, and spraying the coating on an inside surface of the medical appliance with the spray nozzle. The spray nozzle may include a guidance arrangement adapted to redirect a coating exiting the spray nozzle into a radial configuration. The method may include moving the spray nozzle along a length of the medical appliance by possibly sliding the spray nozzle along a rail. The method may include rotating the medical appliance during the moving operation and/or rotating the spray nozzle during the moving operation. The method may include inserting a further spray nozzle in a second opening accessing the interior of the medical appliance. The spray nozzle and the further spray nozzle may be opposingly arranged to form a radial nozzle. The guidance arrangement may include the further spray nozzle.

The further spray nozzle may spray air or gas. The interaction of the air or the gas and the coating from the spray nozzle may atomize the coating. The spray nozzle may eject the coating with an energy about equal to a further energy of the air or the gas ejected by the. further spray nozzle. A front face of the spray nozzle may be arranged opposite a further front face of the further spray nozzle. An outer circumferences of the front face and the further front face may define a radial nozzle. The method may include adjusting the radial nozzle by tightening or loosening a screw adjustment associated with the spray nozzle and/or the further spray nozzle.

A device adapted to hold a medical appliance is provided that includes at least two wires and a tensioning arrangement adapted to introduce tension into the two wires. The at least two wires may be adapted to support the medical appliance from an exterior of the medical appliance. The tensioning arrangement may include a fixed anchor and a spring-loaded anchor. The spring-loaded anchor may move with respect to the fixed anchor to introduce tension into the at least two wires. The at least two wires may include three wires. The at least two wires may be parallel. The at least two parallel wires may include three parallel wires. The three wires may be equi-spaced around a circumference of a cylinder. The cylinder may define a holding position for the medical applicance.

An apparatus for coating an interior of a medical appliance may include a spray nozzle having a diameter less than a further diameter of the interior of the medical appliance, a guidance arrangement arranged opposite the spray nozzle and adapted to deflect a coating exiting the spray nozzle into a radially distributed spray, and a holding arrangement adapted to hold the medical appliance from an exterior while the spray nozzle coats the interior of the medical appliance. The guidance arrangement may include a further spray nozzle adapted to be situated adjacent to the spray nozzle. An outlet of the spray nozzle may be arranged opposite to a further outlet of the further spray nozzle. The further spray nozzle may eject a gas stream and/or an air stream. The outlet of the spray nozzle may include a centrally located circular outlet. The further outlet of the further spray nozzle may include a centrally located circular outlet. The further outlet of the further spray nozzle may include a radially concentric outlet.

A medical appliance having a differential coating applied by a method is provided. The method may include spraying a first coating on an interior of the medical appliance and applying a second coating on an exterior of the medical appliance. The method may include holding the medical appliance from the exterior while spraying the interior. The method may include holding the medical appliance from at least one of at least one end and the interior while applying the second coating on the exterior. The method may include inserting a spray nozzle including a guidance arrangement into an opening of the medical appliance along a central axis of the medical appliance. The medical appliance may be hollow and cylindrical. The method may include inserting a further spray nozzle into a further opening of the medical appliance along the central axis. The guidance arrangement may include the further spray nozzle. A front face of the spray nozzle may be arranged opposite a further front face of the further spray nozzle. An outer circumference of the front face and a further outer circumference of the further front face may define a radial gap nozzle. The operations of spraying the first coating and applying the second coating may be performed sequentially and proximately. The coating applied initially may be wet when the coating is applied. The operation of applying the second coating may include roll coating.

An apparatus for coating an exterior of an object is provided that includes a spray nozzle having a diameter greater than another diameter of the exterior of the object and a guidance arrangement arranged opposite the spray nozzle and adapted to deflect a coating exiting the spray nozzle into a radially inward distributed spray. The guidance arrangement includes another spray nozzle adapted to be situated adjacent to the spray nozzle, an outlet of the spray nozzle arranged opposite to another outlet of the other spray nozzle. The other spray nozzle ejects at least one of a gas stream and an air stream. The outlet of the spray nozzle includes a radially concentric outlet and the other outlet of the other spray nozzle includes another radially concentric outlet. A diameter of one of the radially concentric outlet and the other radially concentric outlet is greater than another diameter of the other of the radially concentric outlet and the other radially concentric outlet.

DETAILED DESCRIPTION

Figure 1:
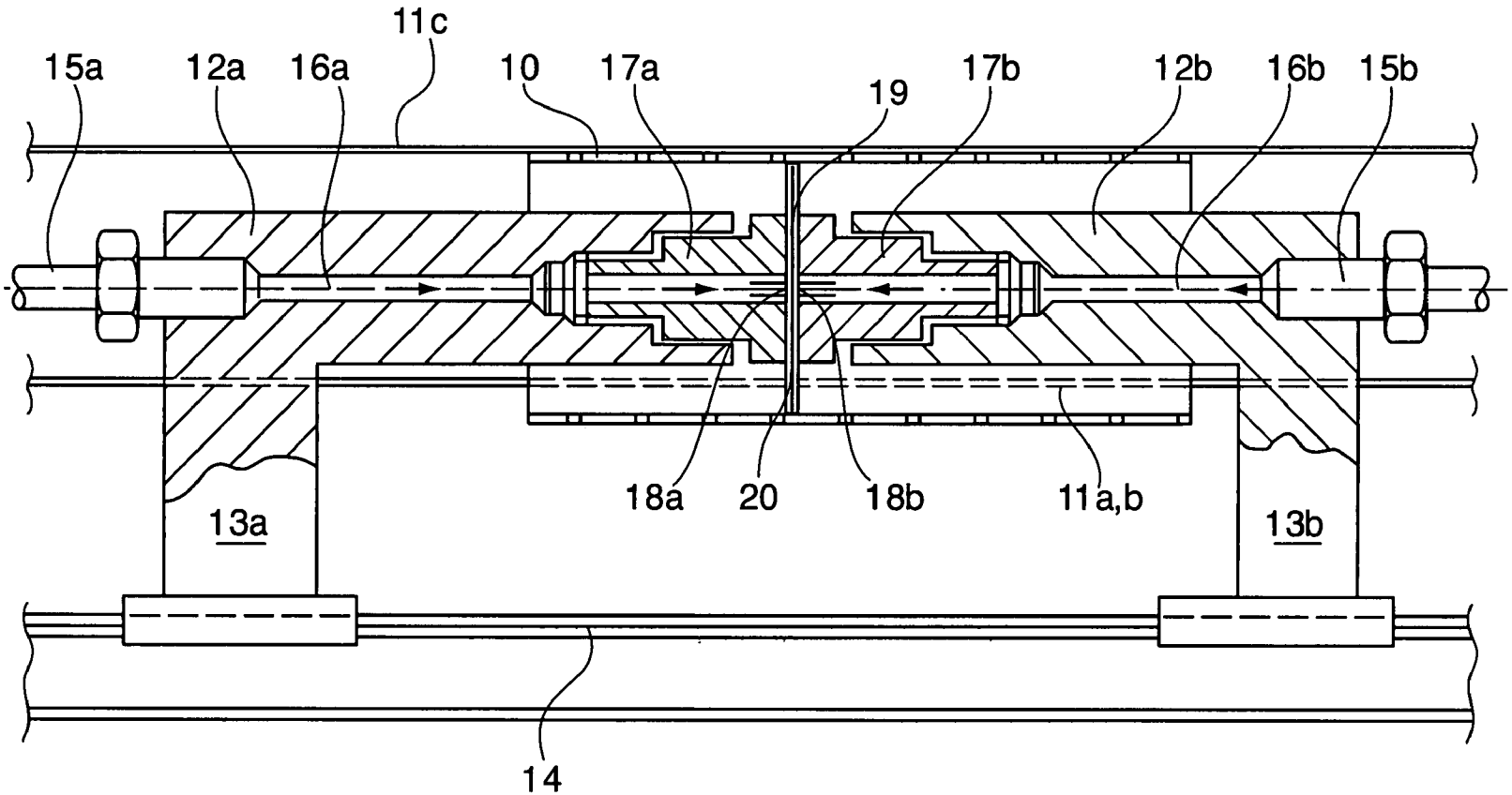
FIG. 1 illustrates an exemplary radial gap spray nozzle system for depositing a coating on the inside of a stent including an exemplary stent holder holding the stent.

An exemplary method of the present invention may provide a process capable of depositing two different, condition-specific drug eluting coatings differentially (without mixing), one on the inside of the stent and one on the outside. In general terms these may include anti-restenotic coatings on the outside, and anti-thrombogenic coatings on the inside. It may also be desirable that, due to low intermolecular bonding forces between polymer-based coatings and highly polished metal, that the two different coatings make sufficient bonding contact at the stent cell edges to ensure retention of both coatings. Accordingly, an exemplary embodiment of the present invention may provide that the two coatings bond and/or weld to each other at the junction with a minimum of overlap.

A new type of coated stent may be provided that is coated by a spray nozzle that has the capability of depositing coating material on to the internal surface of a stent. A new method of holding the stent during the internal coating deposition may be provided. An exemplary embodiment may include a cylindrical nozzle from which the spray plume emerges in a radially outward direction.

The nozzle may be simple and may rely on the fluid mechanics of two opposing fluid flows meeting each other in a confined gap, in which they mix, atomize and from which they are ejected. One fluid may be a drug-eluting coating and the other fluid may be either air, an inert gas, or another gas. Each fluid may be driven towards each other through two co-axial supply tubes. The energy of each fluid stream may be adjusted to be approximately equal in order to ensure that they both exit through their respective primary axial nozzles before they exit from a radial gap nozzle. Precision axial adjustment of the gap may be possible to fine-tune the mixing process. This arrangement of two opposite flow nozzles placed in proximity creates a third nozzle from the gap between them.

The complete internal surface of the stent may be coated in one linear pass of the nozzle relative to the stent, whether or not the stent rotates relative to the nozzle. A screw thread connected to one side of the nozzle may provide an adjustable spray nozzle system in which various atomization characteristics may be obtained by increasing or reducing the radial nozzle gap.

The internally coated stent may be previously or subsequently coated on the outside by any conventional process, including the process described in "Coated Medical Device and Method for Manufacturing the Same" (ref. 10177-095). This article relates to roll coating and may be suited to the purpose of achieving two different drug-eluting coatings on the stent, one on the inside and one on the outside.

Surrounding the stent-coating region with a vacuum extraction system and (possibly a coating recovery system) may ensure that surplus coating material does not adhere to the outside of the stent. Additionally, rotating the stent may assist in ensuring that any surplus coating keeps clear of the outside of the stent. Without rotating the stent, the coating material may tend to settle to the bottom of the stent and may collect on the lower edge of the stent, on the outside. Rotating the nozzle may ensure that small differences in circumferential spraying performance are minimized. Rotating both the stent and nozzles in opposite directions (or alternatively, in the same direction) may provide all of these benefits.

FIG. 1 illustrates an exemplary radial gap spray nozzle system for depositing a coating on the inside of stent 10 including an exemplary stent holder including tension wires 11*a, b, c*. Tension wires 11*a, b* support stent 10 from the bottom. Tension wire 11*c* may optionally be utilized to support stent 10 from the top. Spraying assemblies 12*a* and 12*b* may be supported by spray assembly supports 13*a* and 13*b* respectively and may extend in opposite openings of hollow cylindrical stent 10. Spray assembly supports 13*a* and 13*b* may attach to each other by removably fixed spacer 14, which may determine the distance between spray assembly supports 13*a* and 13*b* and may thereby determine the size of radial gap nozzle 19. Hose assemblies 15*a* and 15*b* may access respective pressurized fluid sources and may supply spray assemblies 12*a* and 12*b*, respectively. One of hose assemblies 15*a* and 15*b* may access a pressurized fluid source including a drug suspended in a polymer, and the other of the hose assemblies 15*a* and 15*b* may access a pressurized gas including air or another gas. Hose assemblies 15*a* and 15*b* may supply pressurized fluids to central channels 16*a* and 16*b* of spray assemblies 12*a* and 12*b*, respectively.

Central channels 16*a* and 16*b* may supply the pressurized fluids to nozzle assemblies 17*a* and 17*b* which may be situated on the ends of spray assemblies 12*a* and 12*b*. Nozzle assemblies 17*a* and 17*b* may each include nozzle openings 18*a* and 18*b*, respectively, out of which the pressurized fluid may flow. Nozzle openings 18*a* and 18*b* may be opposingly arranged with a small distance between them so that the pressurized fluid exiting each nozzle opening 18*a*, b forces the combined pressurized fluid to move radially out between the opposing faces of nozzle assemblies 17*a, b*. The pressurized fluid of the drug/polymer combination may be atomized by the pressurized fluid of the air or gas and may exit from radial gap nozzle 19 formed at an outer circumference of the opposing faces of nozzle assemblies 17*a, b*. Atomized radial fluid stream 20 may exit radial gap nozzle 19 and may be ejected on to an interior side of stent 10.

The pressure of the two fluids exiting nozzle openings 18*a, b* may be selected so that the energy (the momentum, which equals the mass times the velocity) of the fluid streams may be approximately equal. The energy of the fluid streams may be adjusted by adjusting the pressure of the respective fluids. The polymer/drug solution may be more dense than the pressurized air or gas, and therefore may not need to be ejected at as high a pressure as the air or gas in order to have an approximately equal amount of energy.

Figure 2:
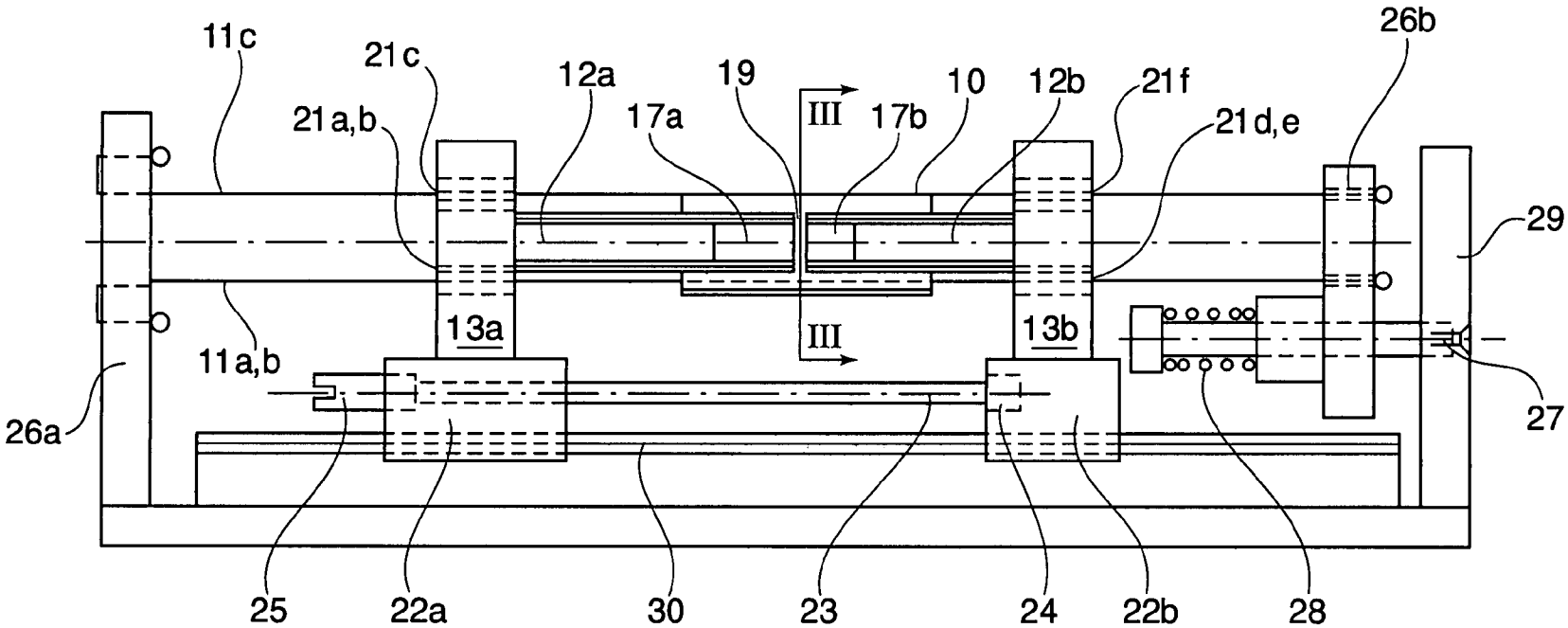
FIG. 2 illustrates the exemplary radial gap spray nozzle system including the exemplary stent holder and stent of FIG. 1 showing additional structure of the stent holder.

FIG. 2 illustrates an exemplary radial gap spray nozzle system including the exemplary stent holder and stent 10, and shows more structure of the stent holder. The exemplary stent holder includes tension wires 11*a, b, c* that support stent 10 from the bottom and top. Tension wires 11*a, b, c* pass through spray assembly supports 13*a* and 13*b* which have an alternative exemplary design to that shown in FIG. 1. In particular, tension wires 11*a, b, c* pass through guide channels 21*a, b, c* respectively of spray assembly support 13*a* and pass through guide channels 21*d, e, f* respectively of spray assembly support 13*b*. Tension wires 11*a, b, c* attach to holder anchors 26*a, b*. Holder anchor 26*b* is shown movably mounted on a tensioning arrangement including slide 27, compression spring 28, and anchor 29. Alternatively, holder anchor 26*a* may include the tensioning arrangement, or holder anchors 26*a*, b may both include tensioning arrangements. Additionally and alternatively, tensioning arrangements utilizing an alternative spring arrangement may be utilized.

Spraying assemblies 12*a* and 12*b* may be supported by spray assembly supports 13*a* and 13*b*, which may in turn be mounted on slide mounts 22*a, b*, respectively. Slide mounts 22*a, b* may be connected by removable rod 23. Removable rod 23 may be fixedly attached to slide mount 22*a*, and removably attached to slide mount 22*b*, by, for instance, magnet 24. Alternative breakable connection mechanisms may be utilized, and alternatively, removable rod 23 may be removably or fixedly attached to slide mount 22*b* and removably attached to slide mount 22*a*. Screw adjuster 25 may be utilized to fine tune the length of removable rod 23 to thereby influence the distance between the front faces of nozzle assemblies 17*a* and 17*b*, which may be attached to spraying assemblies 12*a* and 12*b*, respectively. Adjusting the distance between the front faces of nozzle assemblies 17*a* and 17*b* may adjust radial gap nozzle 19 and may influence the atomization and pressure of the coating material ejected from radial gap nozzle 19. Slide mounts 22*a, b* may be slidably attached to rail 30, and may be able to slide back and forth on rail 30 to enable radial gap nozzle 19 to pass along the entire length, or a predetermined portion of the length, of stent 10. Slide mounts 22*a, b* may be powered by a stepper motor, or any other appropriate means of causing movement along rail 30, and may be controlled synchronously with nozzles 17*a, b* (for instance, by a computer) to coat the entire inside of stent 10 or, alternatively, a predetermined portion of the inside of stent 10.

Line III—III cuts stent 10 at the line of radial gap nozzle 19, and therefore does not intersect any of the nozzles 17*a, b*, but does intersect tension wires 11*a, b, c*.

Figure 3:
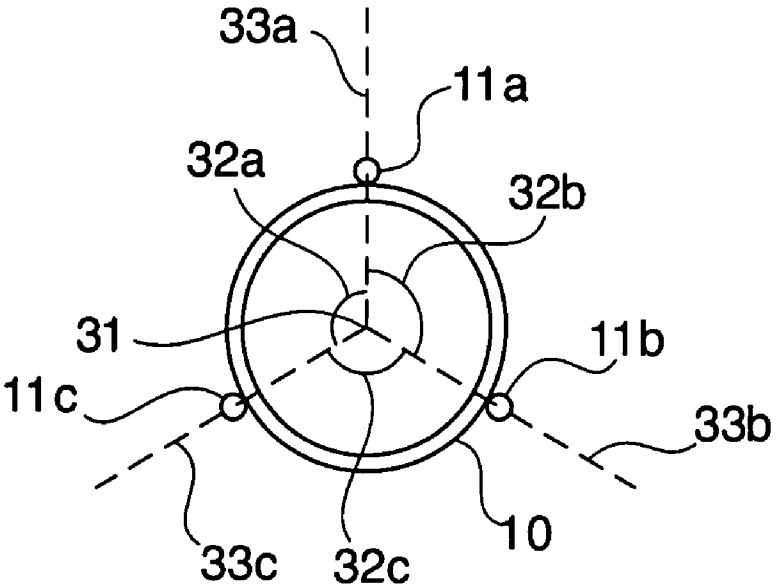
FIG. 3 illustrates a cross-sectional view of the stent holder and stent of FIG. 2 cut along the line III—III.

FIG. 3 illustrates a cross-sectional view of the stent holder and stent 10 of FIG. 2 cut along the line III—III. Tension wires 11*a, b, c* may be arranged equi-spaced around the circumference of stent 10. Central axis 31 is at the center of stent 10. Angles 32*a, b, c* between radii 33*a, b, c* extending from central axis 31 through tension wires 11*a, b, c* may be equal, and may therefore each equal 120 degrees. Alternatively, angles 32*a, b, c* may be unequal, but may equal in aggregate 360 degrees.

Figure 4:
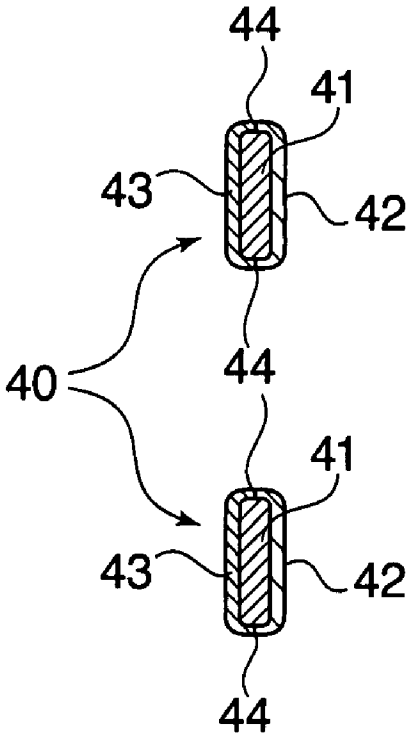
FIG. 4 illustrates a cross-sectional view of two struts of the stent of FIG. 3 showing a differential coating.

FIG. 4 illustrates a cross-sectional view of struts 40 of stent 10 of FIG. 3 showing a differential coating. Struts 40 may include structures 41 that may be composed of stainless steel, nitinol, or any other appropriate material. Each strut 40 may be coated on an inside with interior coat 42 and on an outside with exterior coat 43. Interior coat 42 may include an anti-thrombogenic material. Exterior coat 43 may include an anti-restenosis material. Interior coat 42 may join exterior coat 43 at junction 44, which may be situated in an intermediate region between the inside and the outside of the stent (the top edge and the bottom edge of each strut 40 as shown in FIG. 4).

Alternative exemplary embodiments of nozzle designs in which the fluid from one side passes through an annular primary nozzle and into the atomization gap may be provided. These exemplary embodiments of nozzle designs may increase the thorough mixing of the two fluids (e.g., the polymer-based drug coating and air).

Figure 5:
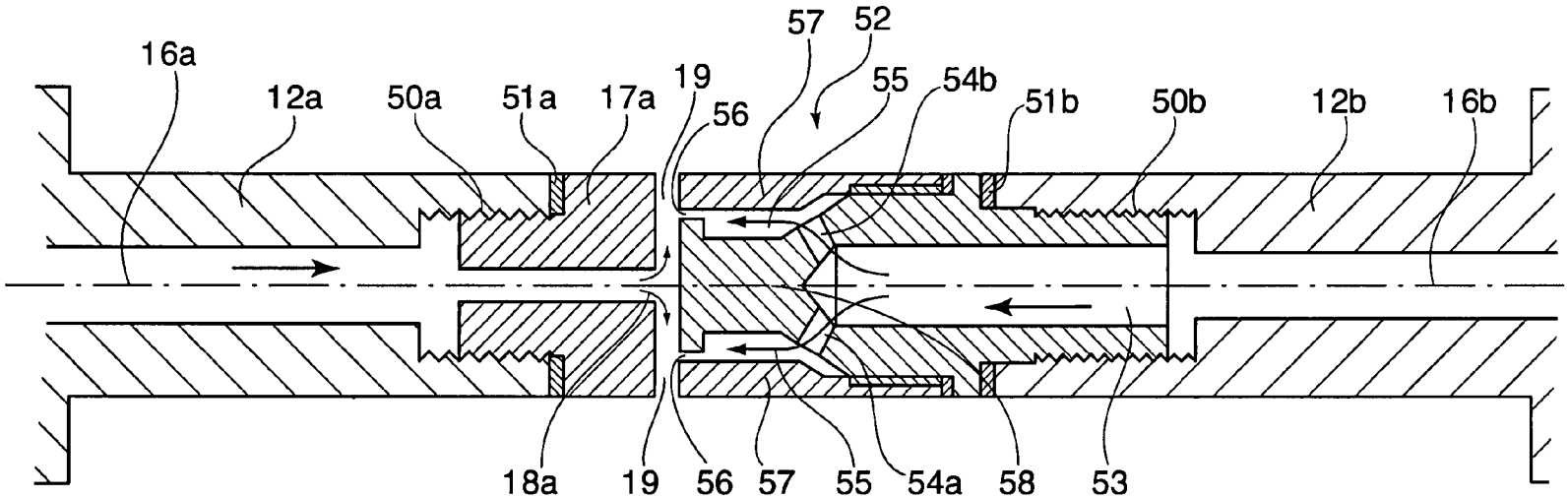
FIG. 5 illustrates an alternative exemplary radial gap spray nozzle system including an alternative exemplary nozzle in cross-section.

FIG. 5 illustrates in a cross-sectional view an alternative exemplary radial gap spray nozzle system including an alternative exemplary nozzle. Spraying assemblies 12*a* and 12*b* may respectively access pressurized fluid including a drug suspended in a polymer, and/or a pressurized gas including air or another gas. The pressurized fluids may be supplied to central channels 16*a* and 16*b* of spray assemblies 12*a* and 12*b*, respectively. Central channel 16*a* may supply a pressurized fluid to nozzle assembly 17*a* that may be situated on an end of spray assembly 12*a*. The pressurized fluid may be a drug suspended in a polymer. Nozzle assembly 17*a* may include nozzle opening 18*a* out of which the pressurized fluid may flow. Nozzle assembly 17*a* may attach to spray assembly 12*a* by screw thread 50*a*, or by any other appropriate alternative method. Gasket 51 a may be situated between nozzle assembly 17*a* and spray assembly 12*a* to create a seal when nozzle assembly 17*a* is attached to spray assembly 12*a*.

Central channel 16*b* may supply a pressurized fluid to concentric nozzle assembly 52 that may be situated on an end of spray assembly 12*b*. The pressurized fluid may be air or another gas. Concentric nozzle assembly 52 may attach to spray assembly 12*b* by screw thread 50*b*, or by any other appropriate alternative method. Gasket 51*b* may be situated between concentric nozzle assembly 52 and spray assembly 12*b* to create a seal when concentric nozzle assembly 52 is attached to spray assembly 12*b*. Central channel 16*b* may feed the pressurized fluid into main channel 53 of concentric nozzle assembly 52. The pressurized fluid may flow from main channel 53 to feeder channels 54*a, b* of concentric nozzle assembly 52. There may be more or fewer feeder channels than two, and the feeder channels may be equi-spaced around a circumference of the exit of main channel 53. Feeder channels 54*a, b* may feed the pressurized fluid into concentric chamber 55, which may be defined on an exterior by outer housing 57 and on an interior by axial piece 58. Axial piece 58 and outer housing 57 also define concentric opening 56, which may define a concentric opening centered around a central axis of concentric nozzle assembly 52.

Concentric opening 56 and nozzle opening 18*a* may be opposingly arranged with a small distance between them so that the pressurized fluid exiting nozzle opening 18*a* moves radially after hitting the front face of axial piece 58. As the pressurized fluid (possibly the polymer/drug combination) passes concentric opening 56, the pressurized fluid exiting concentric opening 56 (possibly air or another gas) combines and possibly atomizes the drug/polymer solution. The atomized drug/polymer solution may exit from radial gap nozzle 19 formed at an outer edge of the circumference of nozzle assembly 17*a* and concentric nozzle assembly 52.

Figure 6:
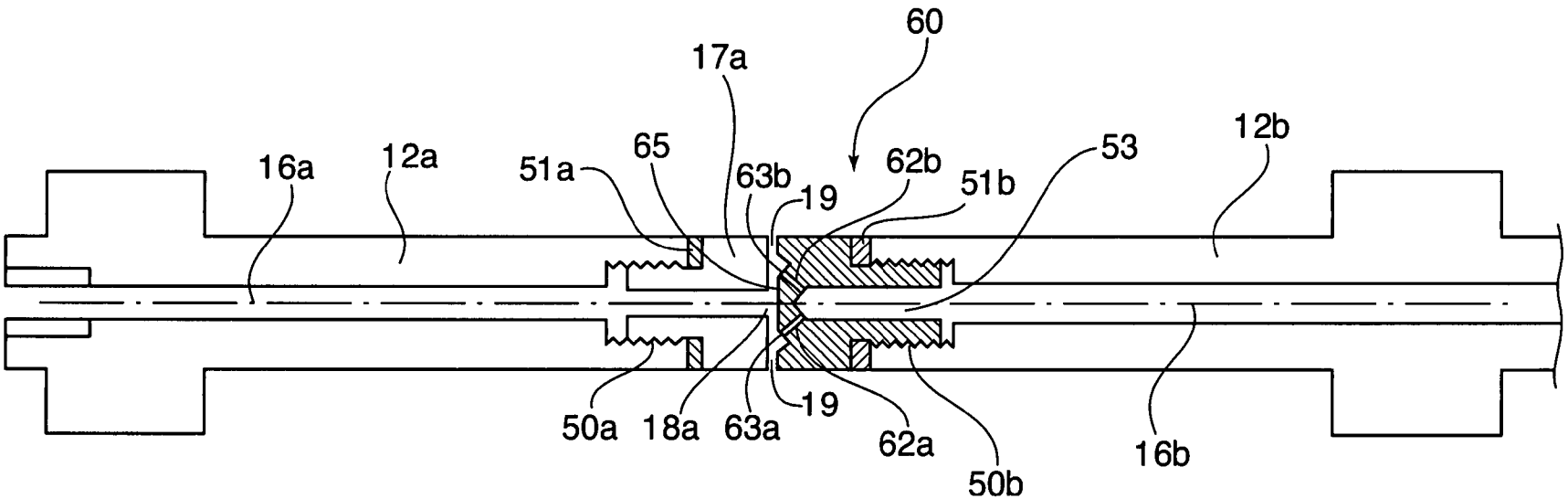
FIG. 6 illustrates a further alternative exemplary radial gap spray nozzle system including a further alternative exemplary nozzle in cross-section.

FIG. 6 illustrates a cross-sectional view of a further alternative exemplary radial gap spray nozzle system including a further alternative exemplary nozzle. Spraying assemblies 12*a* and 12*b* may access pressurized fluid including a drug suspended in a polymer, and/or a pressurized gas including air or another gas, respectively. The pressurized fluids may be supplied to central channels 16*a* and 16*b* of spray assemblies 12*a* and 12*b*, respectively. Central channel 16*a* may supply a pressurized fluid to nozzle assembly 17*a* that may be situated on an end of spray assembly 12*a*. The pressurized fluid may be a drug suspended in a polymer. Nozzle assembly 17*a* may include nozzle opening 18*a* out of which the pressurized fluid may flow. Nozzle assembly 17*a* may attach to spray assembly 12*a* by screw thread 50*a*, or by any other appropriate alternative method. Gasket 51*a* may be situated between nozzle assembly 17*a* and spray assembly 12*a* to create a seal when nozzle assembly 17*a* is attached to spray assembly 12*a*.

Central channel 16*b* may supply a pressurized fluid to angled concentric nozzle assembly 60 that may be situated on an end of spray assembly 12*b*. The pressurized fluid may be air or another gas. Angled concentric nozzle assembly 60 may attach to spray assembly 12*b* by screw thread 50*b*, or by any other appropriate method. Gasket 55*b* may be situated between angled concentric nozzle assembly 60 and spray assembly 12*b* to create a seal when angled concentric nozzle assembly 60 is attached to spray assembly 12*b*. Central channel 16*b* may feed pressurized fluid into main channel 53 of angled concentric nozzle assembly 60. The pressurized fluid may flow from main channel 53 to angled concentric feeder channels 62*a, b* of angled concentric nozzle assembly 60. There may be more or fewer feeder channels than 2, and the feeder channels may be equi-spaced around a circumference of the exit of main channel 53. Angled concentric feeder channels 62*a, b* may be defined on an exterior by angled outer housing 64 and on an interior by angled axial piece 65. Angled axial piece 65 and angled outer housing 64 may also define angled openings 63*a, b* which may be equi-spaced around a concentric opening centered around a central axis of angled concentric nozzle assembly 60. Angled openings 63*a, b* may eject the pressurized fluid.

Angled openings 63*a, b* and nozzle opening 18*a* may be opposingly arranged with a small distance between them so that the pressurized fluid exiting nozzle opening 18*a* moves radially after hitting the front face of angled axial piece 65. As the pressurized fluid (possibly the polymer/drug combination) passes angled openings 63*a, b*, the pressurized fluid exiting angled openings 63*a, b* (possibly, gas or air) combines and possibly atomizes the drug/polymer solution. The atomized drug/polymer solution may exit from radial gap nozzle 19 formed at an outer edge of the circumference of nozzle assembly 17*a* and angled concentric nozzle assembly 60.

Figure 7:
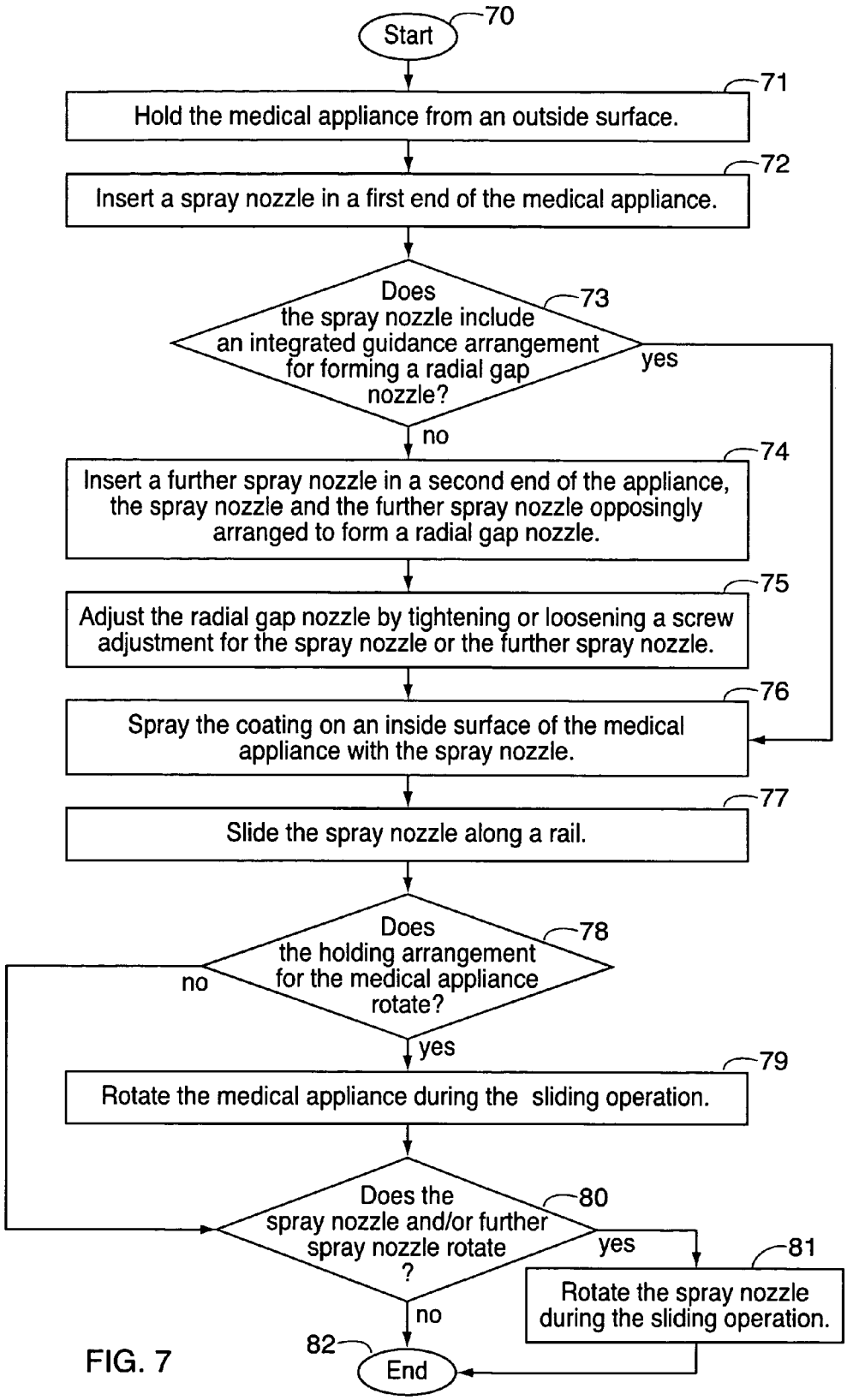
FIG. 7 is a flow chart illustrating an exemplary method according to the present invention.

FIG. 7 is a flow chart illustrating an exemplary method according to the present invention. The method starts in start circle 70 and proceeds to action 71, which indicates to hold the medical appliance from an outside surface. From action 71, the flow proceeds to action 72, which indicates to insert a spray nozzle in a first end of the medical appliance. From action 72, the flow proceeds to question 73, which asks whether the spray nozzle includes an integrated guidance arrangement for forming a radial gap nozzle. If the response to question 73 is negative, the flow proceeds to action 74, which indicates to insert a further spray nozzle in a second end of the medical appliance. In action 74, the spray nozzle and the further spray nozzle are opposingly arranged to form a radial gap nozzle. From action 74, the flow proceeds to action 75, which indicates to adjust the radial gap nozzle by tightening or loosening a screw adjustment for the spray nozzle or the further spray nozzle. From action 75, the flow proceeds to action 76, which indicates to spray the coating on an inside surface of the medical appliance with the spray nozzle. From action 76, the flow proceeds to action 77, which indicates to slide the spray nozzle along a rail. From action 77, the flow proceeds to question 78, which asks whether the holding arrangement for the medical appliance rotates. If the response to question 78 is affirmative, the flow proceeds to action 79, which indicates to rotate the medical appliance during the sliding operation. From action 79, the flow proceeds to question 80, which asks whether the spray nozzle and/or further spray nozzle rotates. If the response to question 80 is affirmative, the flow proceeds to action 81, which indicates to rotate the spray nozzle during the sliding operation. From action 81, the flow proceeds to end circle 82. If the response to question 73 is affirmative, the flow proceeds to action 76. If the response to question 78 is negative, the flow proceeds to question 80. If the response to question 80 is negative, the flow proceeds to end circle 82.

While the process disclosed describes a radial gap spray nozzle in which the spray emerges from the nozzle in a radially outwards direction, a larger annular shaped radial gap nozzle may also be used from which the spray plume would emerge in a radially inwards direction. This exemplary embodiment of a nozzle may have the capability to spray coat the complete external surface of circular objects, and may be more useful in coating uninterrupted or continuous cylindrical surfaces.

Figure 8:
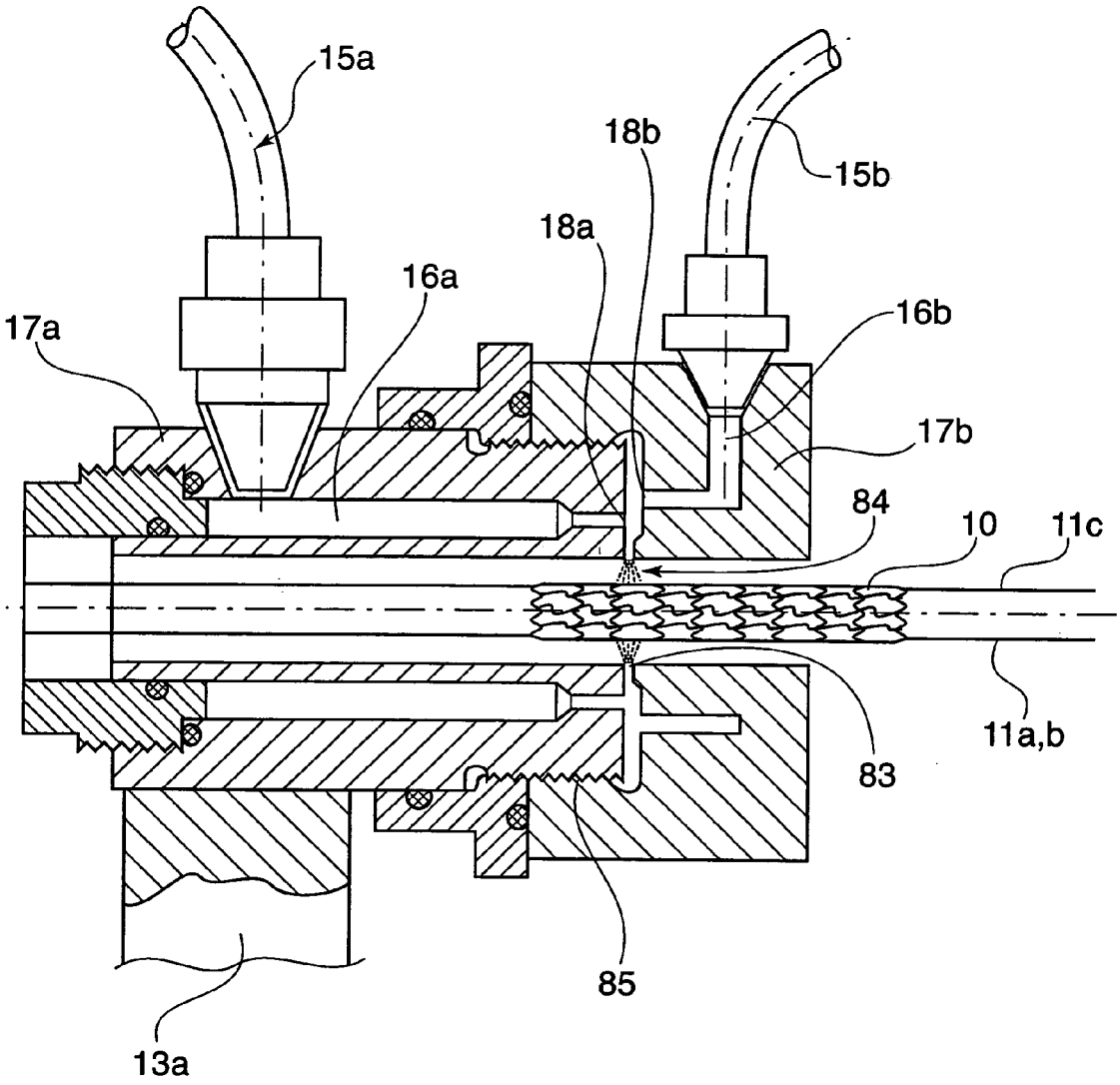
FIG. 8 illustrates a further alternative exemplary spray nozzle system for spraying the exterior of an object including a further alternative exemplary nozzle in cross-section.

FIG. 8 illustrates a further alternative exemplary spray nozzle system for spraying the exterior of stent 10 including a further alternative exemplary nozzle in cross-section. Alternatively, the exemplary nozzle system may be used to coat exteriors of objects other than stents, and may be used to coat objects having a continuous surface. Tension wires 11*a, b* support stent 10 from the bottom. Tension wire 11*c* may optionally be utilized to support stent 10 from the top. Nozzle assemblies 17*a* and 17*b* may be supported collectively by spray assembly support 13*a* and may enclose hollow cylindrical stent 10. Spray assembly support 13*a* may attach directly to nozzle assembly 17*a*. Alternatively, an additional assembly support 13*b* may attach to nozzle assembly 17*b*.

Hose assemblies 15*a* and 15*b* may access respective pressurized fluid sources and may supply nozzle assemblies 17*a* and 17*b*, respectively. One of hose assemblies 15*a* and 15*b* may access a pressurized fluid source including a drug suspended in a polymer, and the other of the hose assemblies 15*a* and 15*b* may access a pressurized gas including air or another gas. Hose assemblies 15*a* and 15*b* may supply pressurized fluids to central channels 16*a* and 16*b* of nozzle assemblies 17*a* and 17*b*, respectively. Nozzle assemblies 17*a* and 17*b* may each include a nozzle opening 18*a* and 18*b* out of which the pressurized fluid may flow. Nozzle openings 18*a* and 18*b* may be opposingly arranged with a small distance between them so that the pressurized fluid exiting each nozzle opening 18*a, b* forces the combined pressurized fluid to move radially inward between the opposing faces of nozzle assemblies 17*a, b*. The distance between nozzle openings 18*a* and 18*b* may be adjustable by adjusting nozzle assembly 17*b* with respect to nozzle assembly 17*a* at adjustable screw thread 85.

The pressurized fluid of the drug/polymer combination may be atomized by the pressurized fluid of the air or gas and may exit from inward radial gap nozzle 83 formed at an inner circumference of the opposing faces of nozzle assemblies 17*a, b*. Hose assembly 15*a* may preferably access a coating fluid supply while hose assembly 15*b* may preferably access a pressurized air supply in order to facilitate the atomization of the coating exiting nozzle opening 18*a*. Atomized inward radial fluid stream 84 may exit inward radial gap nozzle 83 and may be ejected on to an exterior side of stent 10.

The pressure of the two fluids exiting nozzle openings 18*a, b* may be selected so that the energy (the momentum, which equals the mass times the velocity) of the fluid streams may be approximately equal. The energy of the fluid streams may be adjusted by adjusting the pressure of the respective fluids. The polymer/drug solution may be more dense than the pressurized air or gas, and therefore may not need to be ejected at as high a pressure as the air or gas in order to have an approximately equal amount of energy. Alternatively, the pressurized air passing across nozzle opening 18*a* may draw coating out of nozzle opening 18*a* due to a capillary effect and may also atomize coating as it is drawn out of nozzle opening 18*a*.

Figure 9A:
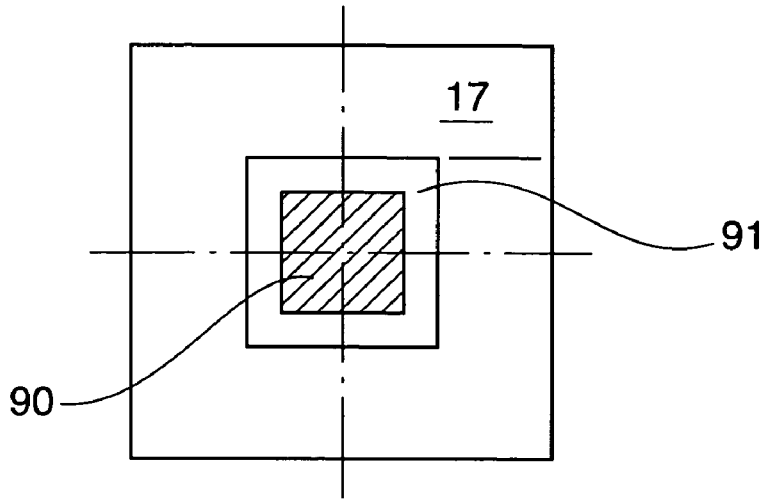
FIG. 9A illustrates an exemplary cross-section of the spray nozzle system of FIG. 8 including an exemplary cross-section of an object to be sprayed.

FIG. 9A illustrates an exemplary cross-section of the spray nozzle system of FIG. 8 including an exemplary cross-section of square object 90 to be sprayed. Nozzle assembly 17 is shown in cross-section and defines a square on an interior. On the inside of nozzle assembly 17 is square object 90. Gap 91 separates the interior of nozzle assembly 17 and the exterior of square object 90. Gap 91 is approximately equal at all points between adjacent sections of the interior of nozzle assembly 17 and the exterior of square object 90.

Figure 9B:
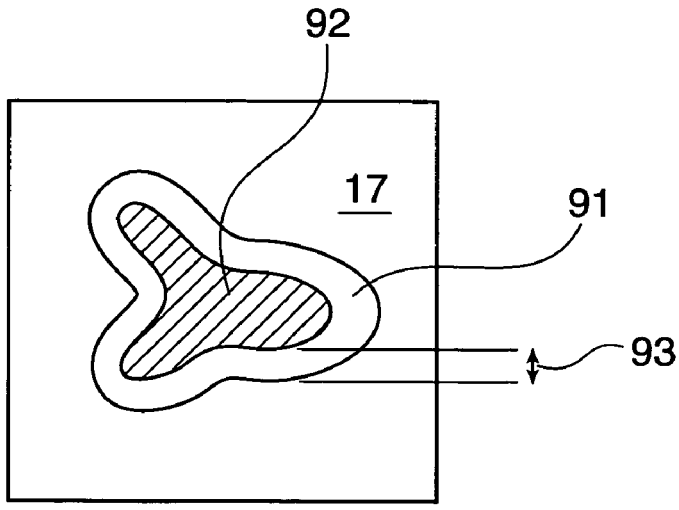
FIG. 9B illustrates a further exemplary cross-section of the spray nozzle system of FIG. 8 including a further exemplary cross-section of an object to be sprayed.

FIG. 9B illustrates a further exemplary cross-section of the spray nozzle system of FIG. 8 including an exemplary cross-section of irregular object 92 to be sprayed. Nozzle assembly 17 is shown in cross-section and defines an irregular shape on an interior. On the inside of nozzle assembly 17 is irregular object 92. Gap 91 separates the interior of nozzle assembly 17 and the exterior of irregular object 92. Gap 91 is approximately equal at all points between adjacent sections of the interior of nozzle assembly 17 and the exterior of irregular object 92, and is approximately equal to distance 93.

A radially inward facing gap nozzle may be used to coat the exterior of cylindrical or approximately cylindrical objects. Two opposing streams of fluids (for example, a bio-active material mixed in a liquid polymer and a gas) may be constrained to exit and atomize through a narrow annular gap which is positioned on the inside cylindrical surface of the nozzle housing. This arrangement may essentially be the inverse of the first exemplary embodiment. The nozzle housing may provide the barrier to the fluid streams to direct the atomized coating inward.

The inward-facing annular gap nozzle may be suited to coating a cylindrical object. Use of this exemplary embodiment of a nozzle in coating a surface with openings may cause coating to coalesce near the center since opposingly directed sprays may interact in the middle. A stent, with a large number of openings cut through a thin-walled tube, may allow a large proportion of the total material sprayed to pass to the space inside the stent, where the coating may have no available surface upon which to deposit. The coating may therefore tend to coalesce together. In an inward-facing annular gap nozzle, all the atomized droplets may move radially inwards and converge at the center, unless this movement is interrupted by a workpiece surface.

Several exemplary methods may prevent droplets from converging at the center of a latticed workpiece. A high-speed jet of air may be directed axially into the center of the stent and surplus coating material may be collected for re-processing. This system may be combined with a vacuum assisted collection system. Additionally or alternatively, a cylindrical mask may be placed on the inside of the stent to provide a surface upon which overrun droplets may deposit.

Alternative exemplary embodiments of inward facing gap nozzles utilize nozzle section shapes other than circular ones. A prism cross-section nozzle may be used for spray coating prism-like objects. Alternatively, a square inner section nozzle may be suited to spray coating square section objects, for instance, a square bar of metal.

Figure 10:
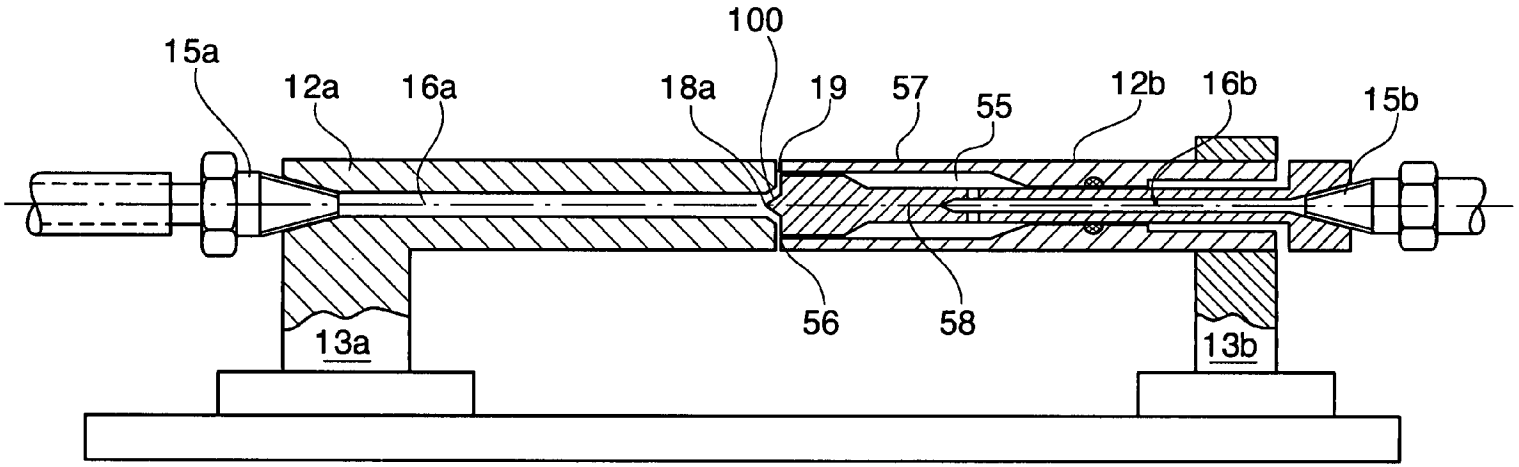
FIG. 10 illustrates an alternative exemplary radial gap spray nozzle system including an alternative exemplary nozzle in cross-section.

FIG. 10 illustrates an alternative exemplary radial gap spray nozzle system including an alternative exemplary nozzle in cross-section which may be adapted to accommodate unequal fluid energies and/or unequal pressures. Spraying assemblies 12*a* and 12*b* may be supported by spray assembly supports 13*a* and 13*b* respectively. Hose assemblies 15*a* and 15*b* may access respective pressurized fluid sources and may supply spray assemblies 12*a* and 12*b*, respectively. One of hose assemblies 15*a* and 15*b* may access a pressurized fluid source including a drug suspended in a polymer, and the other of hose assemblies 15*a* and 15*b* may access a pressurized gas including air or another gas. Hose assemblies 15*a* and 15*b* may supply pressurized fluids to central channels 16*a* and 16*b* of spray assemblies 12*a* and 12*b*, respectively.

Central channel 16*a* may supply the pressurized fluid to nozzle opening 18*a*, out of which the pressurized fluid may flow. Central channel 16*b* may supply the pressurized fluid into concentric chamber 55, which may be defined on an exterior by outer housing 57 and on an interior by axial piece 58. Axial piece 58 and outer housing 57 also define concentric opening 56, which may define a concentric opening centered around a central axis.

Concentric opening 56 and nozzle opening 18*a* may be opposingly arranged with a small distance between them so that the pressurized fluid exiting nozzle opening 18*a* moves radially after hitting the front face of axial piece 58, which may be formed into dispersing projection 100. As the pressurized fluid passes concentric opening 56, the pressurized fluid exiting concentric opening 56 combines and possibly atomizes the drug/polymer solution. The atomized drug/polymer solution may exit from radial gap nozzle 19 formed at an outer edge of the circumference of spray assemblies 12*a* and 12*b*.

The pressure of the two fluids exiting nozzle opening 18*a* and concentric opening 56 may be selected to be unequal. The polymer/drug solution may be more dense than the pressurized air or gas and may not need to be ejected from the nozzle opening and may be drawn out of the nozzle opening by the venturi effect if the pressurized air is at a sufficiently higher pressure than the polymer/drug solution. Either of nozzle opening 18*a* and concentric opening 56 may used to supply the polymer/drug solution, and the other of nozzle opening 18*a* and concentric opening 56 may be used to supply the pressurized air or gas.

Figure 11:
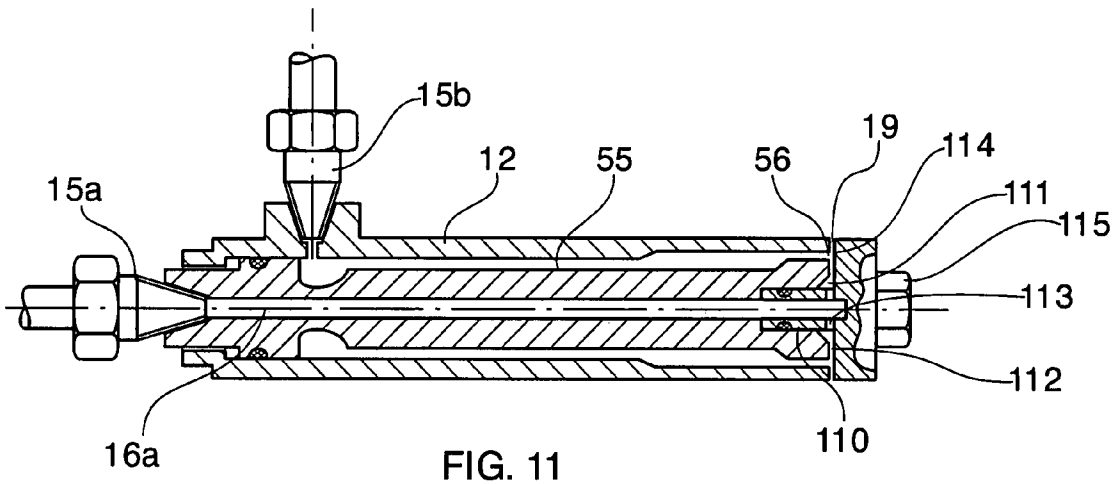
FIG. 11 illustrates an alternative exemplary radial gap spray nozzle system including an alternative exemplary nozzle in cross-section.

FIG. 11 illustrates an alternative exemplary radial gap spray nozzle system including an alternative exemplary nozzle in cross-section which may be inserted in one end of a hollow cylindrical object to coat the interior of the object and which may be adapted to accommodate unequal fluid energies and/or unequal pressures. Hose assemblies 15*a* and 15*b* may access respective pressurized fluid sources and may supply spray assembly 12. One of hose assemblies 15*a* and 15*b* may access a pressurized fluid source including a drug suspended in a polymer, and the other of hose assemblies 15*a* and 15*b* may access a pressurized gas including air or another gas. Hose assembly 15*a* may supply pressurized fluid to central channel 16*a* of spray assembly 12. Hose assembly 15*b* may supply pressurized fluid into concentric chamber 55. Concentric chamber 55 may supply pressurized fluid through concentric opening 56 opposite guidance barrier 114.

Central channel 16*a* may supply pressurized fluid through outlets 113 in endpiece 110 into end chamber 111, which may be concentric. From outlet 113, the pressurized fluid may flow through concentric channel 112 to meet with concentric opening 56. The pressurized fluid flowing through concentric channel 112 may be an air or gas and may have a higher pressure than the pressurized fluid flowing through concentric opening 56, which may be a polymer drug solution. In this situation, the higher pressure air or gas may atomize the lower pressure polymer/drug solution and may draw the low pressure polymer/drug solution out of concentric opening 56 by the venturi effect. Alternatively, concentric opening 56 may supply a higher pressure air or gas and concentric channel 112 may supply a lower pressure polymer/drug solution. In this situation, the higher pressure air or gas would draw the lower pressure polymer/drug solution out of concentric channel 112 by the venturi effect. In both cases, the atomized drug/polymer solution may exit from radial gap nozzle 19 formed at an outer edge of the circumference of spray assembly 12.

Endpiece 110 may be adjustable by screw 115 to increase or decrease the width of concentric channel 112, the width of radial gap nozzle 19, and/or the distance between concentric opening 56 and guidance barrier 114.

Figure 12:
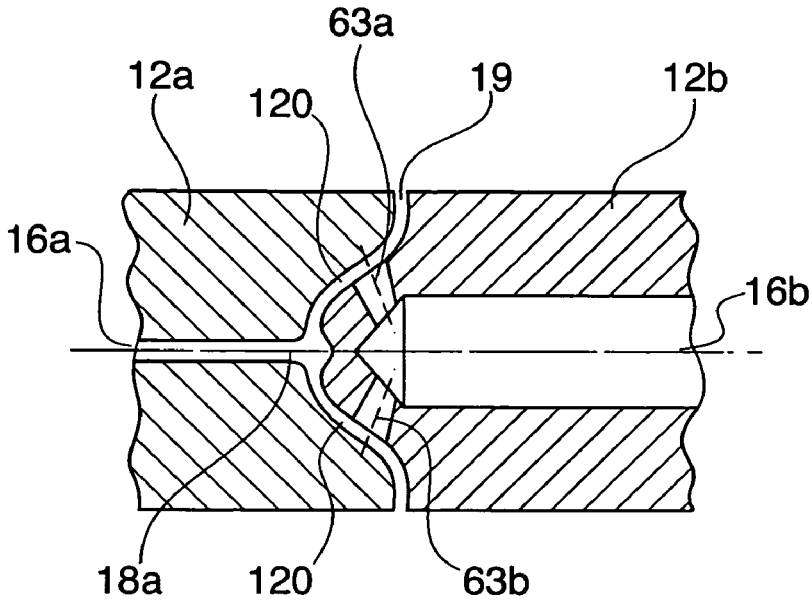
FIG. 12 illustrates a blown-up view of an alternative exemplary nozzle in cross-section.

FIG. 12 illustrates a blown-up view of an alternative exemplary nozzle in cross-section which may be adapted to accommodate unequal fluid energies and/or unequal pressures. Spraying assemblies 12*a* and 12*b* include central channels 16*a* and 16*b*, respectively. Central channel 16*a* may supply pressurized fluid to nozzle opening 18*a*, out of which the pressurized fluid may flow. The pressurized fluid flowing out of nozzle opening 18*a* may be a higher pressure air or gas or a lower pressure polymer/drug solution. Central channel 16*b* may supply pressurized fluid into angled openings 63*a, b*. The pressurized fluid flowing into angled openings 63*a, b* may be a higher pressure air or gas or a lower pressure polymer/drug solution. The pressurized flowing from angled openings 63*a, b* may mix with the pressurized fluid flowing from nozzle opening 18*a* in curved concentric channel 120. At this point, the higher pressure air or gas may atomize the lower pressure polymer/drug solution by the venturi effect. The atomized drug/polymer solution may exit from radial gap nozzle 19 formed at an outer edge of the circumference of spray assemblies 12*a* and 12*b*.

Figure 13:
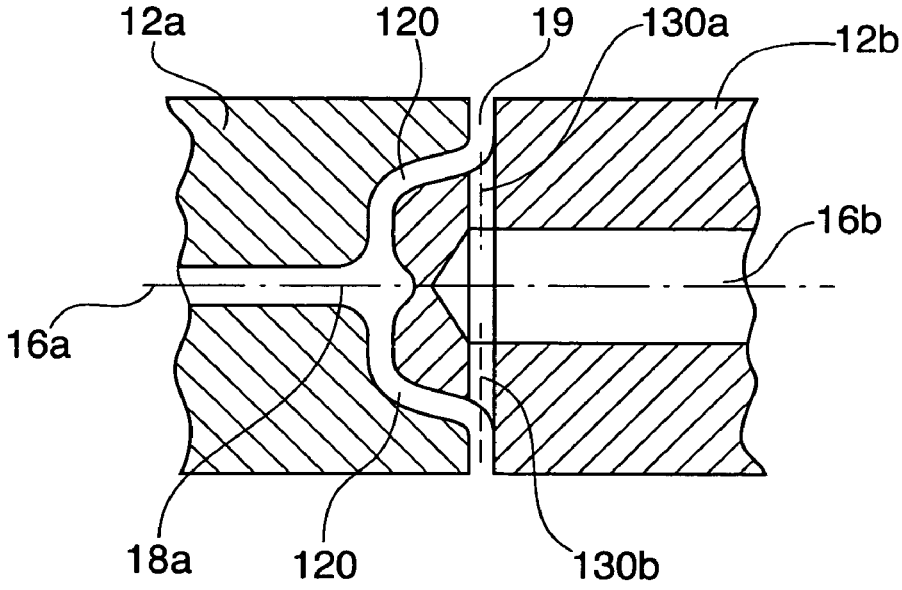
FIG. 13 illustrates a blown-up view of an alternative exemplary nozzle in cross-section.

FIG. 13 illustrates a blown-up view of an alternative exemplary nozzle in cross-section which may be adapted to accommodate unequal fluid energies and/or unequal pressures. Spraying assemblies 12*a* and 12*b* include central channels 16*a* and 16*b*, respectively. Central channel 16*a* may supply the pressurized fluid to nozzle opening 18*a*, out of which the pressurized fluid may flow. The pressurized fluid flowing out of nozzle opening 18*a* may be a higher pressure air or gas or a lower pressure polymer/drug solution. Central channel 16*b* may supply the pressurized fluid into linear openings 130*a, b*. The pressurized fluid flowing into linear openings 130*a, b* may be a higher pressure air or gas or a lower pressure polymer/drug solution. The pressurized flowing from linear openings 130*a, b* may mix with the pressurized fluid flowing from nozzle opening 18*a* in curved concentric channel 120. At this point, the higher pressure air or gas may atomize the lower pressure polymer/drug solution by the venturi effect. The atomized drug/polymer solution may exit from radial gap nozzle 19 formed at an outer edge of the circumference of spray assemblies 12*a* and 12*b*.

Medical implants are used for innumerable medical purposes, including the reinforcement of recently re-enlarged lumens, the replacement of ruptured vessels, and the treatment of disease such as vascular disease by local pharmacotherapy, i.e., delivering therapeutic drug doses to target tissues while minimizing systemic side effects. Such localized delivery of therapeutic agents has been proposed or achieved using medical implants which both support a lumen within a patient's body and place appropriate coatings containing absorbable therapeutic agents at the implant location. Examples of such medical devices include catheters, guide wires, balloons, filters (e.g., vena cava filters), stents, stent grafts, vascular grafts, intraluminal paving systems, implants and other devices used in connection with drug-loaded polymer coatings. Such medical devices are implanted or otherwise utilized in body lumina and organs such as the coronary vasculature, esophagus, trachea, colon, biliary tract, urinary tract, prostate, brain, and the like.

The term "therapeutic agent" as used herein includes one or more "therapeutic agents" or "drugs". The terms "therapeutic agents" and "drugs" are used interchangeably herein and include pharmaceutically active compounds, nucleic acids with and without carrier vectors such as lipids, compacting agents (such as histones), viruses (such as adenovirus, andenoassociated virus, retrovirus, lentivirus and α-virus), polymers, hyaluronic acid, proteins, cells and the like, with or without targeting sequences.

Specific examples of therapeutic agents used in conjunction with the present invention include, for example, pharmaceutically active compounds, proteins, cells, oligonucleotides, ribozymes, anti-sense oligonucleotides, DNA compacting agents, gene/vector systems (i.e., any vehicle that allows for the uptake and expression of nucleic acids), nucleic acids (including, for example, recombinant nucleic acids; naked DNA, cDNA, RNA; genomic DNA, cDNA or RNA in a non-infectious vector or in a viral vector and which further may have attached peptide targeting sequences; antisense nucleic acid (RNA or DNA); and DNA chimeras which include gene sequences and encoding for ferry proteins such as membrane translocating sequences ("MTS") and herpes simplex virus-1 ("VP22")), and viral, liposomes and cationic and anionic polymers and neutral polymers that are selected from a number of types depending on the desired application. Non-limiting examples of virus vectors or vectors derived from viral sources include adenoviral vectors, herpes simplex vectors, papilloma vectors, adeno-associated vectors, retroviral vectors, and the like. Non-limiting examples of biologically active solutes include anti-thrombogenic agents such as heparin, heparin derivatives, urokinase, and PPACK (dextrophenylalanine proline arginine chloromethylketone); antioxidants such as probucol and retinoic acid; angiogenic and anti-angiogenic agents and factors; anti-proliferative agents such as enoxaprin, angiopeptin, rapamycin, angiopeptin, monoclonal antibodies capable of blocking smooth muscle cell proliferation, hirudin, and acetylsalicylic acid; anti-inflammatory agents such as dexamethasone, prednisolone, corticosterone, budesonide, estrogen, sulfasalazine, acetyl salicylic acid, and mesalamine; calcium entry blockers such as verapamil, diltiazem and nifedipine; antineoplastic/antiproliferative/anti-mitotic agents such as paclitaxel, 5-fluorouracil, methotrexate, doxorubicin, daunorubicin, cyclosporine, cisplatin, vinblastine, vincristine, epothilones, endostatin, angiostatin and thymidine kinase inhibitors; antimicrobials such as triclosan, cephalosporins, aminoglycosides, and nitrofurantoin; anesthetic agents such as lidocaine, bupivacaine, and ropivacaine; nitric oxide (NO) donors such as linsidomine, molsidomine, L-arginine, NO-protein adducts, NO-carbohydrate adducts, polymeric or oligomeric NO adducts; anticoagulants such as D-Phe-Pro-Arg chloromethyl ketone, an RGD peptide-containing compound, heparin, antithrombin compounds, platelet receptor antagonists, anti-thrombin antibodies, anti-platelet receptor antibodies, enoxaparin, hirudin, Warfarin sodium, Dicumarol, aspirin, prostaglandin inhibitors, platelet inhibitors and tick antiplatelet factors; vascular cell growth promotors such as growth factors, growth factor receptor antagonists, transcriptional activators, and translational promotors; vascular cell growth inhibitors such as growth factor inhibitors, growth factor receptor antagonists, transcriptional repressors, translational repressors, replication inhibitors, inhibitory antibodies, antibodies directed against growth factors, bifunctional molecules consisting of a growth factor and a cytotoxin, bifunctional molecules consisting of an antibody and a cytotoxin; cholesterol-lowering agents; vasodilating agents; agents which interfere with endogenous vascoactive mechanisms; survival genes which protect against cell death, such as anti-apoptotic Bcl-2 family factors and Akt kinase; and combinations thereof. Cells can be of human origin (autologous or allogenic) or from an animal source (xenogeneic), genetically engineered if desired to deliver proteins of interest at the insertion site. Any modifications are routinely made by one skilled in the art.

Polynucleotide sequences useful in practice of the invention include DNA or RNA sequences having a therapeutic effect after being taken up by a cell. Examples of therapeutic polynucleotides include anti-sense DNA and RNA; DNA coding for an anti-sense RNA; or DNA coding for tRNA or rRNA to replace defective or deficient endogenous molecules. The polynucleotides can also code for therapeutic proteins or polypeptides. A polypeptide is understood to be any translation product of a polynucleotide regardless of size, and whether glycosylated or not. Therapeutic proteins and polypeptides include as a primary example, those proteins or polypeptides that can compensate for defective or deficient species in an animal, or those that act through toxic effects to limit or remove harmful cells from the body. In addition, the polypeptides or proteins that can be injected, or whose DNA can be incorporated, include without limitation, angiogenic factors and other molecules competent to induce angiogenesis, including acidic and basic fibroblast growth factors, vascular endothelial growth factor, hif-1, epidermal growth factor, transforming growth factor α and β, platelet-derived endothelial growth factor, platelet-derived growth factor, tumor necrosis factor α, hepatocyte growth factor and insulin like growth factor; growth factors; cell cycle inhibitors including CDK inhibitors; anti-restenosis agents, including p15, p16, p18, p19, p21, p27, p53, p57, Rb, nFkB and E2F decoys, thymidine kinase ("TK") and combinations thereof and other agents useful for interfering with cell proliferation, including agents for treating malignancies; and combinations thereof. Still other useful factors, which can be provided as polypeptides or as DNA encoding these polypeptides, include monocyte chemoattractant protein ("MCP-1"), and the family of bone morphogenic proteins ("BMP's"). The known proteins include BMP-2, BMP-3, BMP-4, BMP-5, BMP-6 (Vgr-1), BMP-7 (OP-1), BMP-8, BMP-9, BMP-10, BMP-11, BMP-12, BMP-13, BMP-14, BMP-15, and BMP-16. Currently preferred BMP's are any of BMP-2, BMP-3, BMP-4, BMP-5, BMP-6 and BMP-7. These dimeric proteins can be provided as homodimers, heterodimers, or combinations thereof, alone or together with other molecules. Alternatively or, in addition, molecules capable of inducing an upstream or downstream effect of a BMP can be provided. Such molecules include any of the "hedgehog" proteins, or the DNA's encoding them.

Coatings used with an exemplary embodiment of the present invention may comprise a polymeric material/drug agent matrix formed, for example, by admixing a drug agent with a liquid polymer, in the absence of a solvent, to form a liquid polymer/drug agent mixture. Curing of the mixture typically may occur in-situ. To facilitate curing, a cross-linking or curing agent may be added to the mixture prior to application thereof. Addition of the cross-linking or curing agent to the polymer/drug agent liquid mixture should not occur too far in advance of the application of the mixture in order to avoid over-curing of the mixture prior to application thereof.

Curing may also occur in-situ by exposing the polymer/drug agent mixture, after application to the luminal surface, to radiation such as ultraviolet radiation or laser light, heat, or by contact with metabolic fluids such as water at the site where the mixture has been applied to the luminal surface. In coating systems employed in conjunction with the present invention, the polymeric material may be either bioabsorbable or biostable. Any of the polymers described herein that may be formulated as a liquid may be used to form the polymer/drug agent mixture.

In an exemplary embodiment, the polymer used to coat the medical device may be provided in the form of a coating on an expandable portion of a medical device. After applying the drug solution to the polymer and evaporating the volatile solvent from the polymer, the medical device may be inserted into a body lumen where it may be positioned in a target location. In the case of a balloon catheter, the expandable portion of the catheter may subsequently be expanded to bring the drug-impregnated polymer coating into contact with the lumen wall. The drug may be released from the polymer as it slowly dissolves into the aqueous bodily fluids and diffuses out of the polymer. This may enable administration of the drug to be site-specific, limiting the exposure of the rest of the body to the drug.

It is within the scope of the present invention to apply multiple layers of polymer coating onto a medical device. Such multiple layers may be of the same or different polymer materials.

The polymer of the present invention may be hydrophilic or hydrophobic, and may be selected from the group consisting of polycarboxylic acids, cellulosic polymers, including cellulose acetate and cellulose nitrate, gelatin, polyvinylpyrrolidone, cross-linked polyvinylpyrrolidone, polyanhydrides including maleic anhydride polymers, polyamides, polyvinyl alcohols, copolymers of vinyl monomers such as EVA, polyvinyl ethers, polyvinyl aromatics, polyethylene oxides, glycosaminoglycans, polysaccharides, polyesters including polyethylene terephthalate, polyacrylamides, polyethers, polyether sulfone, polycarbonate, polyalkylenes including polypropylene, polyethylene and high molecular weight polyethylene, halogenated polyalkylenes including polytetrafluoroethylene, polyurethanes, polyorthoesters, proteins, polypeptides, silicones, siloxane polymers, polylactic acid, polyglycolic acid, polycaprolactone, polyhydroxybutyrate valerate and blends and copolymers thereof as well as other biodegradable, bioabsorbable and biostable polymers and copolymers. Coatings from polymer dispersions such as polyurethane dispersions (BAYHDROL®, etc.) and acrylic latex dispersions are also within the scope of the present invention. The polymer may be a protein polymer, fibrin, collagen and derivatives thereof, polysaccharides such as celluloses, starches, dextrans, alginates and derivatives of these polysaccharides, an extracellular matrix component, hyaluronic acid, or another biologic agent or a suitable mixture of any of these, for example. In one embodiment of the invention, the preferred polymer is polyacrylic acid, available as HYDROPLUS® (Boston Scientific Corporation, Natick, Mass.), and described in U.S. Pat. No. 5,091,205, the disclosure of which is hereby incorporated herein by reference. U.S. Pat. No. 5,091,205 describes medical devices coated with one or more polyisocyanates such that the devices become instantly lubricious when exposed to body fluids. In another preferred embodiment of the invention, the polymer is a copolymer of polylactic acid and polycaprolactone.

While the present invention has been described in connection with the foregoing representative embodiment, it should be readily apparent to those of ordinary skill in the art that the representative embodiment is exemplary in nature and is not to be construed as limiting the scope of protection for the invention as set forth in the appended claims.

What is claimed is:

1. An apparatus for coating an interior of an object, comprising:

a spray nozzle sized to move within an interior space defined by the object;

a guidance arrangement arranged opposite the spray nozzle and configured to deflect a coating exiting the spray nozzle into a radially outward distributed spray;

a holding arrangement including at least two wires configured to hold the object from an exterior while the spray nozzle coats the interior of the object; and a tensioning arrangement configured to introduce tension into the at least two wires.

2. The apparatus according to claim 1, wherein:

the guidance arrangement comprising an axial piece and a housing forming another nozzle, the axial piece including a face situated opposite to the spray nozzle, wherein the axial piece face is configured to deflect a coating exiting the spray nozzle into a radially outward distributed spray and towards the other nozzle such that the other nozzle ejects a fluid stream to atomize the coating.

3. The apparatus according to claim 2, wherein:

the axial piece face has a diameter greater than the diameter of the spray nozzle.

4. The apparatus according to claim 2, wherein:

an outer diameter of the other spray nozzle is less than the spray nozzle diameter.

5. The apparatus according to claim 2, wherein:

the other spray nozzle is angled.

6. The apparatus according to claim 2, wherein:

the axial piece and the outer housing have angled portions which form the other spray nozzle.

7. The apparatus according to claim 1, further comprising:

at least one screw adjustment to adjust the radial nozzle.

8. The apparatus according to claim 1, wherein:

the object is an implantable medical device.

9. The apparatus according to claim 1, wherein:

the object is a stent.

10. The apparatus according to claim 1, wherein:

the tensioning arrangement includes a fixed anchor and a spring-loaded anchor, the spring-loaded anchor moving with respect to the fixed anchor to introduce tension into the at least two wires.

11. The apparatus according to claim 1, wherein:

the at least two wires includes three wires.

12. The apparatus according to claim 11, wherein:

the at least two wires are parallel.

13. The apparatus according to claim 12, wherein:

the at least two parallel wires includes three parallel wires.

14. The apparatus according to claim 13, wherein:

the three wires are equi-spaced around a circumference of a cylinder, the cylinder defining a holding position for the medical device.

15. An apparatus for coating an interior of an implantable medical device, comprising:

a spray nozzle sized to move within an interior space of the implantable medical device;

a guidance arrangement arranged opposite the spray nozzle and configured to deflect a coating exiting the spray nozzle into a radially outward distributed spray; and a holding arrangement configured to hold the implantable medical device from an exterior while the spray nozzle coats the interior of the implantable medical device, the holding arrangement comprising at least two wires and a tensioning arrangement configured to introduce tension into the two wires, wherein the at least two wires are configured to support the implantable medical device from an exterior of the implantable medical device.

16. The apparatus according to claim 15, wherein:

the guidance arrangement includes another spray nozzle configured to be situated adjacent to the spray nozzle, an outlet of the spray nozzle arranged opposite to another outlet of the other spray nozzle.

17. The apparatus according to claim 16, wherein:

the other outlet of the other spray nozzle includes a centrally located circular outlet.

18. The apparatus according to claim 16, wherein:

the other outlet of the other spray nozzle includes a radially concentric outlet.

19. The apparatus according to claim 16, wherein:

the other spray nozzle ejects at least one of a gas stream and an air stream, the interaction of the one of the gas stream and air stream from the other spray nozzle atomizing the coating.

20. The apparatus according to claim 15, wherein:

the spray nozzle comprises a passage, the passage containing a therapeutic agent.

21. The apparatus according to claim 15, wherein:

the outlet of the spray nozzle includes a radially concentric outlet.

22. The apparatus according to claim 15, wherein:

the tensioning arrangement includes a fixed anchor and a spring-loaded anchor, the spring-loaded anchor moving with respect to the fixed anchor to introduce tension into the at least two wires.

23. The apparatus according to claim 15, wherein:

the at least two wires includes three wires.

24. The apparatus according to claim 15, wherein:

the at least two wires are parallel.

25. The apparatus according to claim 24, wherein:

the at least two parallel wires includes three parallel wires.

26. The apparatus according to claim 25, wherein:

the three wires are equi-spaced around a longitudinal axis.

27. An apparatus for coating an interior of an implantable medical device, comprising:

a first spray nozzle sized to move within an interior space of the implantable medical device, the first spray nozzle comprising an outlet and a solid front face;

a guidance arrangement arranged opposite the first spray nozzle, the guidance arrangement comprises a second spray nozzle sized to move within an interior space of the implantable medical device, the second spray nozzle comprising an outlet and a solid front face, the solid front face of the second spray nozzle configured to deflect a coating exciting the outlet of the first spray nozzle into a radially outward distributed spray, the solid front face of the first spray nozzle being arranged opposite the outlet of the second spray nozzle; and a holding arrangement configured to hold the implantable medical device from an exterior while the spray nozzle coats the interior of the implantable medical device.

28. The apparatus according to claim 27, further comprising:

at least one screw adjustment to adjust the radial nozzle.

29. The apparatus according to claim 27, wherein:

the outlet of the first spray nozzle and the outlet of the second spray nozzle are concentric.

* * * * *

UNITED STATES PATENT AND TRADEMARK OFFICE

CERTIFICATE OF CORRECTION

PATENT NO. : 7,335,264 B2
APPLICATION NO. : 10/830330
DATED : February 26, 2008
INVENTOR(S) : Motherwell et al.

It is certified that error appears in the above-identified patent and that said Letters Patent is hereby corrected as shown below:

Column 2, line 49, “the. Further” should be changed to --the further--;

Column 2, lines 52-53, “An outer circumferences” should be changed to --The outer circumferences--;

Column 3, line 4, “applicance” should be changed to --appliance--;

Column 5, lines 62-63, “opening 18*a*, b” should be changed to --opening 18*a*, *b*--;

Column 6, line 28 “anchors 26*a*, b” should be changed to --anchors 26*a*, *b*--;

Column 6, line 32, “Spraying” should be changed to --Spray--;

Column 7, line 36, “Gasket 51 a” should be changed to --Gasket 51*a*--;

Column 8, line 8, “Spraying” should be changed to --Spray--;

Column 8, line 29, “Gasket 55*b*” should be changed to --Gasket 51*b*--;

Column 8, line 43, “outer housing 64” should be changed to --outer housing--;

Column 9, line 50, “support 13b” should be changed to --support--;

Column 14, line 19, “promotors” should be changed to --promoters--;

Column 14, line 21, “promotors” should be changed to --promoters--;

Column 14, line 29, “vascoactive” should be changed to --vasoactive--;

Column 15, line 2, “(“BMP’s)” should be changed to --(“BMPs”)--;

Column 15, line 5, “BMP’s” should be changed to --BMPs--; and

UNITED STATES PATENT AND TRADEMARK OFFICE

CERTIFICATE OF CORRECTION

PATENT NO. : 7,335,264 B2
APPLICATION NO. : 10/830330
DATED : February 26, 2008
INVENTOR(S) : Motherwell et al.

It is certified that error appears in the above-identified patent and that said Letters Patent is hereby corrected as shown below:

Column 15, line 12, “DNA’s” should be changed to --DNAs--.

Signed and Sealed this

Ninth Day of June, 2009

JOHN DOLL
*Acting Director of the United States Patent and Trademark Office*